US006453646B1

(12) United States Patent
Schneider

(10) Patent No.: US 6,453,646 B1
(45) Date of Patent: Sep. 24, 2002

(54) METHOD FOR PRODUCING BAGS

(75) Inventor: Jakob Schneider, Niederkassel (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 0 days.

(21) Appl. No.: 09/647,258

(22) PCT Filed: Mar. 11, 1999

(86) PCT No.: PCT/EP99/01580

§ 371 (c)(1),
(2), (4) Date: Oct. 19, 2000

(87) PCT Pub. No.: WO99/48677

PCT Pub. Date: Sep. 30, 1999

(30) Foreign Application Priority Data

Mar. 24, 1998 (DE) ..... 198 12 739

(51) Int. Cl.[7] ..... B65B 43/26; B31B 49/04

(52) U.S. Cl. ..... 53/457; 53/459; 53/570; 53/572; 493/204; 493/199

(58) Field of Search ..... 53/455, 457, 459, 53/562, 570, 571, 572, 573; 493/189, 199, 203, 204; 414/20, 789.7, 790.2, 790.4

(56) References Cited

U.S. PATENT DOCUMENTS 3,555,977 A * 1/1971 Saumsiegle ..... 493/204
4,021,291 A * 5/1977 Joice ..... 156/515
4,342,564 A * 8/1982 Lehmacher ..... 493/204
4,468,276 A * 8/1984 Membrino ..... 493/204
4,487,599 A * 12/1984 Bendig et al. ..... 493/204
4,526,639 A * 7/1985 Reimann ..... 493/204
4,670,083 A * 6/1987 Menbrino ..... 493/204
4,699,607 A * 10/1987 Lambrecht ..... 493/204
4,903,839 A * 2/1990 Mattiebe et al. ..... 206/554
4,925,439 A * 5/1990 Schneider ..... 493/204
5,030,191 A 7/1991 Reifenhauser
5,226,858 A * 7/1993 Snowdon ..... 493/204
6,363,694 B1 * 4/2002 Riedinger ..... 53/459

FOREIGN PATENT DOCUMENTS

DE 38 34 115 C1 5/1990

* cited by examiner

*Primary Examiner*—Stephen F. Gerrity
*Assistant Examiner*—Louis Huynh
(74) *Attorney, Agent, or Firm*—Herbert Dubno; Andrew Wilford

(57) ABSTRACT

The invention relates to a method and a device for continuously producing, handling and filling bags (8), especially bags for handling by automatic machines, formed from a thermoplastic line of film. The aim of the invention is to facilitate handling in the logistical sequence between the bags (8) being produced and being filled and to improve the quality of the bag stacks (6). To this end, the bags (8) are attached (22) in places, then held in place in the area of a packing machine by holding elements (31) which interact with suspension holes (18). The attachment (22) on the bag stack (6) is then removed, after which the bags (8) are filled. The filling movement releases the bags (8) from the holding elements (31) and the bags (8) are finally sealed. The bags (8) are advantageously separated by a clamping and pulling-apart apparatus located in the area of the packing machine.

7 Claims, 2 Drawing Sheets

METHOD FOR PRODUCING BAGS

CROSS REFERENCE TO RELATED APPLICATIONS

This application is the U.S. national phase of PCT application PCT/EP99/01580 filed Mar. 11, 1999 with a claim to the priority of German patent application 19812739.1 itself filed Mar. 24, 1998.

FIELD OF THE INVENTION

The invention is related first to a method for the continuous production, handling, and filling of bags, in particular automatic-machine bags made from a thermoplastic synthetic-resin web having at least one hang-up hole at a filling end, wherein the bags are held together in stacks but are filled and then closed individually.

STATE OF THE ART

In the continuous production of bags the bags are brought together by an assembling device in a predetermined number to so-called bag stacks. An input device is formed for example by a horizontally movable pin-type stack conveyor which carries the separated bags on wicket pins. A problem with all the bag-making machines with downstream collecting or stacking devices is matching the throughput capacity of the stacking and collecting devices to the continuously working bag-welding machine that cycles very quickly during bag manufacture with very small pauses while finished bags are pulled from the stacking station and an empty stacking device is fed into the stacking station. In the production of bag stacks it is known to fix them together with a staple. To this end either the bag stack is lifted from the pins of the pin-type stack conveyor and the stacked but not attached bags are set on the legs of the staple, or the legs of the staple are inserted along grooves in the pins of the pin-type stack conveyor and in this manner the bag stack is transferred. Subsequently the bag stack is secured by washers or plugs fitted to the staple legs. This procedure is usually carried out manually by a worker. Attempts have been made to automate the staple insertion and the bag removal. A transfer device of this type is seen for example in German 3,834,115.

It is known from practice that the quality of such bags leaves much to be desired in part because packaging such bag stacks is fairly difficult because of the staples. In addition handling in such a system is relatively expensive. Also, the staple must be covered on both sides with paper strips in the box but once un-packed by an automatic machine the staple must be cleared of its washers or plugs so that the bags can be efficiently filled. Finally the staple must be sent back to the manufacture, that is the bag plant, so that it can be used again.

OBJECT OF THE INVENTION

It is an object of the invention to provide a method of the above-described type that ensures simplified handling in the logistical step between the production and filling of bags, in particular automatic-machine bags, made from a thermoplastic synthetic-resin strip as well as to provide a higher-quality stack formed from a plurality of bags. In addition an apparatus should be provided that simply allows an optimal preparation of the bags fed to the bag stack in order to fill them.

This object is attained with respect to the method in that during the production process the stacked bags are blocked together at locations near their fill openings and that in a preliminary station upstream of a filling station of a filling machine the bag stack is held together by a holding element fitting through the hang-up holes and then the bag stack is deblocked, whereupon the separated bags are filled in the filling station with a filling movement stripping the bags from the holding element and finally the bags are closed.

The system according to the invention eliminates the staple by using a relatively easy blocking to simplify the manufacture and production of the bags, in particular automatic-machine bags. Removal of the bag staple by the pin-type conveyor is now therefore substantially simpler. At the same time the quality of the bag stack is substantially improved and backing of the bags in a box is simplified since there is no bothersome staple. In particular the production and further handling of the bags is made cheaper since moving the staple between the unpacker and the manufacturer is eliminated. It is only necessary to hold the bags in a stack together in the unpacking station and to remove the blocking produced during manufacture of the bags in the stack.

Optimal relationships in the work flow are in particular obtained when two blocking regions and two hang-up holes are provided in an upper flap near the fill opening of each bag, a spacing between the limited-area blocking regions being greater than a spacing between the hang-up holes.

In order to simplify subsequent removal of the blocking it is advantageous when the blocking regions are of semicircular shape at an edge of the upper flaps and the semicircular shape of the blocking regions is delimited by a perforation line formed in the bag stack.

In this manner it is possible to remove all the blocking regions delimited by perforation lines for a stack in the preliminary station of the feed machine as an end block. The removal is effected by a shear movement. Alternatively it is possible to effect the removal by cutting the end blocks out of the bag stack.

With respect to the apparatus the idea according to the invention can be effected particularly simply when the apparatus for feeding blocked bag stacks to a filling in station in particular of an automatic filling machine has a bag holding device and an end-block holding device movable relative thereto. The bag holding device and the end-block holding device each have upper and lower clamping members. The upper and lower clamping members of the end-block holding device constituted as openable and closable pincers. A direction of movement of the pincers is generally vertical.

BRIEF DESCRIPTION OF THE DRAWING

A preferred embodiment of the invention is shown in the drawing and is more closely described in the following. In the schematic drawing.

EMBODIMENT OF THE INVENTION

Figure 1:
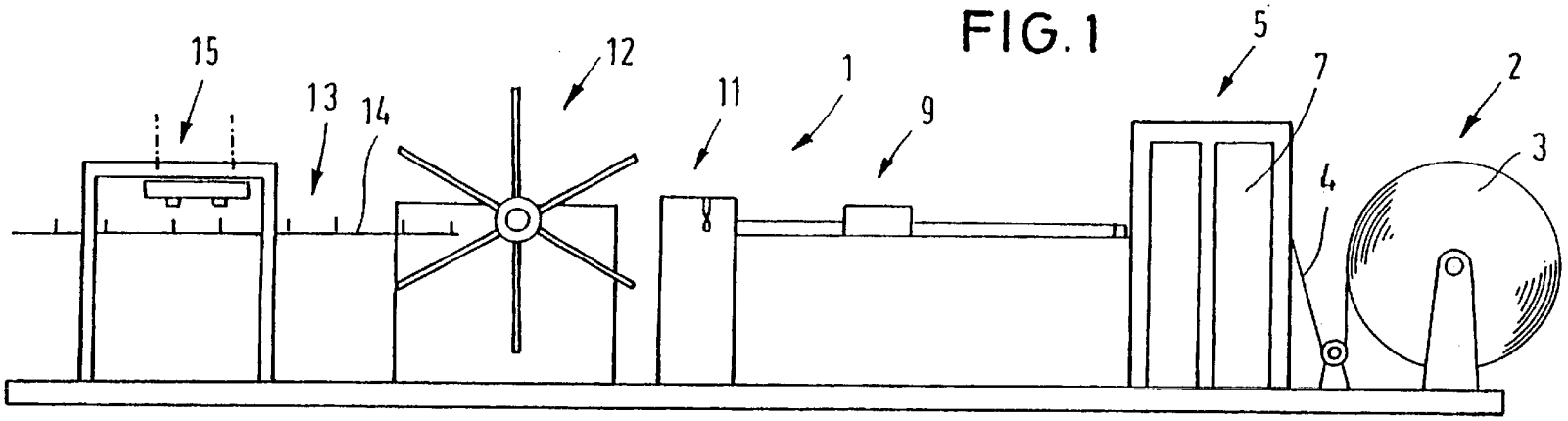
FIG. 1 is a side view of a bag-making machine.
Figure 2:
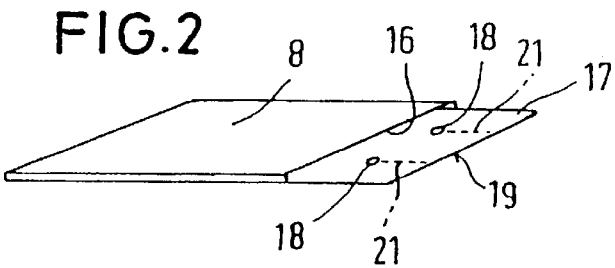
FIG. 2 is a perspective view of an individual bag.

FIG. 1 schematically shows a bag-making machine 1 that is set up for making and orienting bags, in particular so-called automatic-machine bags. The bag-making machine has an unwinder 2 with a supply roll 3 of a thermoplastic synthetic-resin strip. The latter can be formed from a tubular foil strip 7. The tubular foil strip 4 is guided inside an only schematically illustrated handling machine 5 by means of unillustrated built-in drive and tensioning rollers. According to the type of bag the treating station 5 has side and bottom folding devices 7. Downstream of the treating station 5 is a hole-punch device 9. The hole-punch-device 9 is followed by a transverse cutting device 11 as well as a transfer device 12 which finally leads to a stacking device 13 with a pin-type stack conveyor 14. Near the pin-type stack conveyor 14 is finally a blocking station 15. This leads to an unillustrated unloading station for blocked bag stacks. Such bag stacks 6 are shown in more detail in FIG. 3. As seen there they are formed of a predetermined number of individual bags 8 as shown in FIG. 2. The individual bags 8 each have in the region of a fill opening 16 an upper tab 17 extending past an end and in which two hang-up holes 18 are punched from which short perforation lines 21 run to an outer edge 19 of the upper flap 17.

Figure 3:
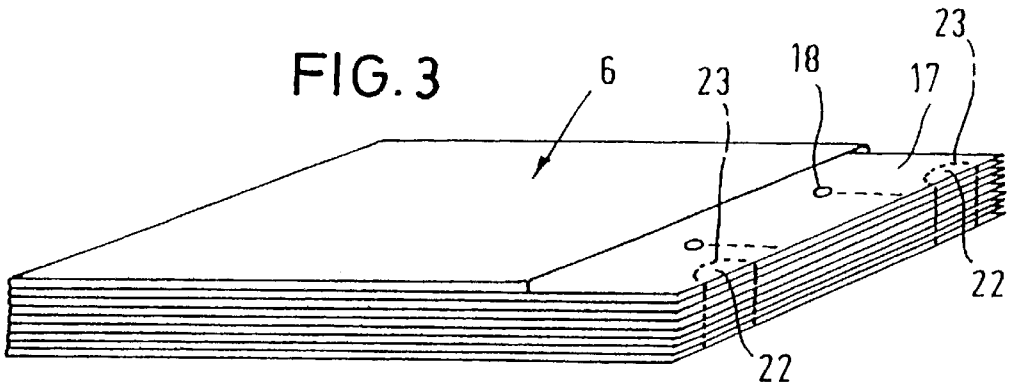
FIG. 3 is a similar view of a bag stack made of a plurality of bags.

After making a bag stack 6 as shown in FIG. 3 the bag stacks are provided in the region of their upper flaps 17 with blocking regions 22 that extend the entire height of the stack and that hold the individual bags 8 in the stack. In the illustrated embodiment the blocking regions 22 are delimited by a perforation line 23 that extends as a semicircle from the edge 19 of the upper flap. Thus blocked bag stacks are packaged in an unillustrated box and then transported to where they are unpacked. In order to make possible rapid filling of the individual bags it is necessary to prepare the bags and bring them into an optimal filling position. This is shown in detail in FIGS. 4 and 5.

Figure 4:
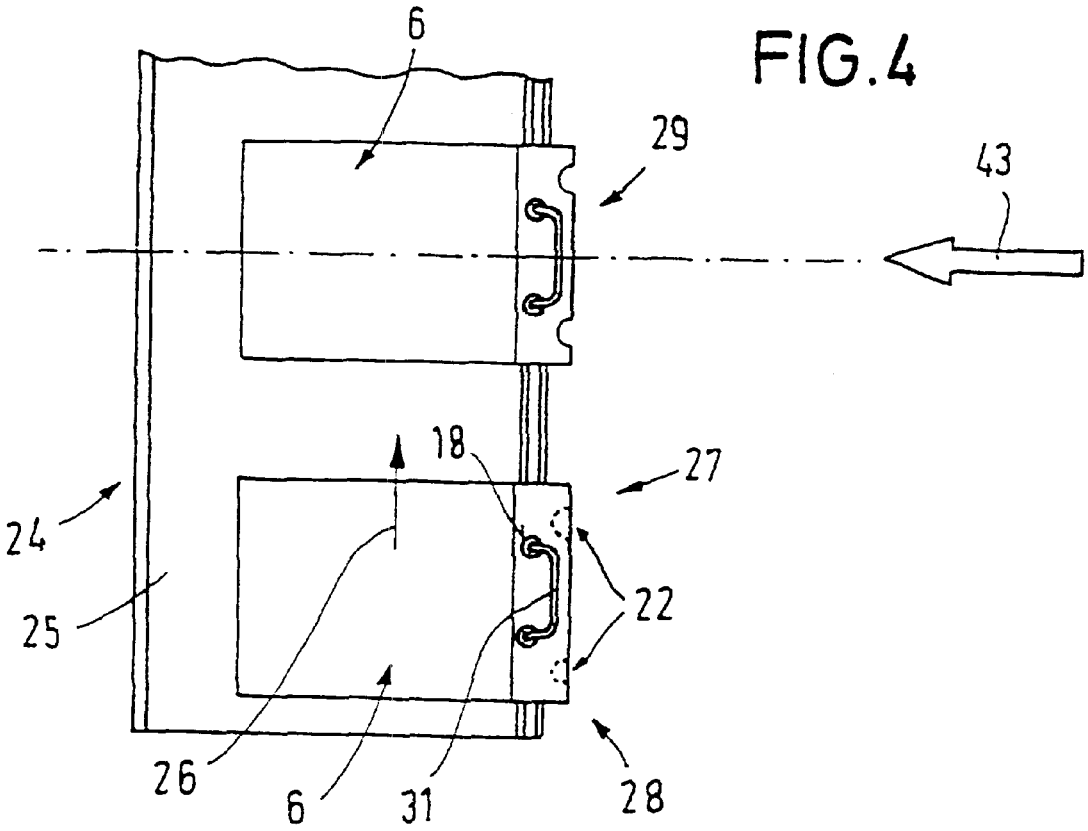
FIG. 4 is a top view of a filling machine with a preliminary position of a feed device.
Figure 5:
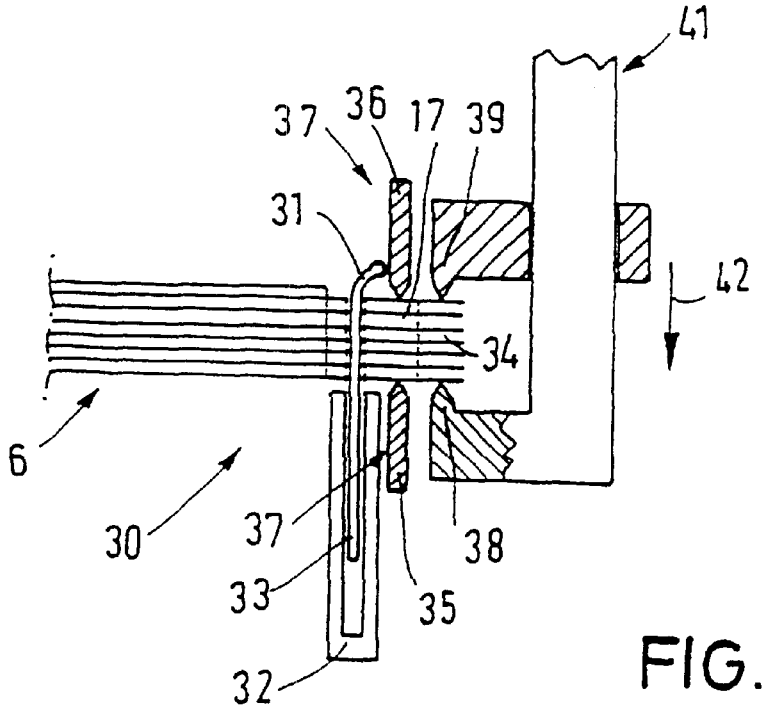
FIG. 5 is in enlarged view a detail of a deblocking device.

FIG. 4 shows part of a filling station 24 which has a support surface 25 on which the bag stacks 6 are moved in the direction of arrow 26. Movement is effected at first from a preliminary position 27 of a feed station 28 into a filling station 29 in which as described below the bag can be filled with a product, for example with bread or a similarly form-stable object or even possibly with flexible materials. In order that this can be fully accomplished with each one it is first necessary to secure the bag stack 6 in the preliminary station 27 by means of a holding element 31 for example formed as a staple. As shown in FIG. 5 the legs 33 of the staple engage in the slot of a generally U-shaped bar 32 on which the front blocked end of the bag stack 6 is supported. For this holding the staple legs 33 of the staple 32 engage through the holes 18 of the bags 8. When the bag stack 6 comes into the preliminary position 27 the bag stack as shown in FIG. 4 is blocked together by the blocking regions 22. In the preliminary position 27 the deblocking device 30 shown in FIG. 5 makes it possible to tear end blocks 34 including the blocking regions from the bag stack. To this end the front ends of the bags are fixed at the upper flap by lower clamp members 35 and upper clamp members 36 of a bag-clamping device 37. Simultaneously an end-block clamping device 41 grips the end blocks 34 between lower clamping members 38 and upper clamping members 39 and this end-block clamping device 41 moves downward as shown by arrow 42 relative to the stationary clamping device 37 for the bags so that as a result of the thus produced shear the end blocks 34 are separated from the bag stack.

Instead of a clamping arrangement as in FIG. 5 the end blocks 34 can also be removed from the bag stack without separating the end blocks 34 by a perforation. In this case the end blocks must actually be cut in the preliminary position from the bag stack.

After deblocking the bag stack one is left with individual bags 8 centered by the staple 31 so that they can be moved along the support surface 25 by unillustrated means to the filling station 29. There the upper bag will be pulled open by an overhead suction lifter so that the slider 43 illustrated diagrammatically in FIG. 4 can slide the unillustrated product into the open bag 8. The insertion movement of the slider 43 is longer for each bag than the distance between the hang-up holes 18 and the outer edge 19 of the upper flap 17 bridged by the perforation lines 21 so that the bag is pulled free of the holding legs 33 of the staple 31. Then the bag is closed in the known manner and transported off.

What is claimed is:

1. A method of making and filling bags, the method comprising the steps of sequentially:

forming into a stack a plurality of bags each having an open end provided with an end flap formed with at least one hole with the end flaps and holes aligned in the stack;

blocking together the stack of bags by adhering together blocking regions of the end flaps, whereby the stack is stabilized;

transporting the blocked bag stack to a preliminary station of a filling machine;

inserting a holding member through the holes of the blocked bag stack;

removing the blocking regions of the bags of the stack and thereby leaving the bags of the stack only stabilized relative to each other by the holding member;

transporting the bags held together by the holding member to a filling station of the filling machine; and inserting a product into the bags one after the other and generally simultaneously stripping the bags from the holding member.

2. The method defined in claim 1 wherein the bags are each formed with an arcuate perforation line delimiting the respective blocking region and extending to a bag edge, the blocking regions being removed by tearing all the blocking regions of all the bags of a stack simultaneously at the respective perforation lines as an end block.

3. The method defined in claim 2 wherein the blocking regions are removed by clamping the bag stack adjacent the blocking regions, gripping the blocking regions of all the bags in the stack, and displacing the gripped blocking regions and bag stack transversely relative to each other to tear the regions loose at the respective perforation lines.

4. The method defined in claim 1 wherein each bag is formed with two blocking regions and two holes in the respective upper flap, the blocking regions of each bag being spaced apart by a distance greater than a spacing between the two holes.

5. An apparatus for making and filling bags, the apparatus comprising:

means for stacking a plurality of bags each having an open end provided with an end flap formed with at least one hole with the end flaps and holes aligned;

means for blocking together the stacked bags by adhering together blocking regions of the end flaps, whereby the stack is stabilized;

means for transporting the blocked bag stack to a preliminary station of a filling machine;

means for inserting a holding member through the holes of the blocked bag stack;

means for removing the blocking regions of the bags of the stack and thereby leaving the bags of the stack only stabilized relative to each other by the holding member;

means for transporting the bags held together by the holding member to a filling station of the filling machine; and means for inserting a product into the bags one after the other and generally simultaneously stripping the bags from the holding member.

6. The apparatus defined in claim 5 wherein the means for removing includes first clamp members for gripping the bag stack adjacent the blocking regions and second clamp members movable relative to the first clamp members for gripping the blocking regions.

7. The apparatus defined in claim 6 wherein the first members grip the bag stack from above and below and hold it stationary and the second members also grip the blocking regions from above and below and are movable vertically relative to the first members.

* * * * *